US009751305B2

(12) United States Patent
Gejima et al.

(10) Patent No.: US 9,751,305 B2
(45) Date of Patent: Sep. 5, 2017

(54) LIQUID DISCHARGE HEAD AND RECORDING DEVICE USING THE SAME

(71) Applicant: KYOCERA Corporation, Kyoto-shi, Kyoto (JP)

(72) Inventors: Kenko Gejima, Kirishima (JP); Hiroyuki Kawamura, Kirishima (JP); Naoki Kobayashi, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/118,311

(22) PCT Filed: Feb. 19, 2015

(86) PCT No.: PCT/JP2015/054619
§ 371 (c)(1),
(2) Date: Aug. 11, 2016

(87) PCT Pub. No.: WO2015/125865
PCT Pub. Date: Aug. 27, 2015

(65) Prior Publication Data

US 2017/0182772 A1 Jun. 29, 2017

(30) Foreign Application Priority Data

Feb. 19, 2014 (JP) ..... 2014-029654

(51) Int. Cl.
*B41J 2/045* (2006.01)
*B41J 2/14* (2006.01)

(52) U.S. Cl.
CPC ..... *B41J 2/14201* (2013.01); *B41J 2/14233* (2013.01); *B41J 2/14274* (2013.01)

(58) Field of Classification Search
CPC B41J 2/14201; B41J 2/14233; B41J 2/14274; B41J 2/1429
See application file for complete search history.

(56) References Cited

U.S. PATENT DOCUMENTS

2010/0214359 A1 8/2010 Von Essen et al.
2010/0214380 A1* 8/2010 Essen ..... B41J 2/055 347/85

(Continued)

FOREIGN PATENT DOCUMENTS

JP 2009-143168 A 7/2009
JP 2010-241121 A 10/2010
JP 2013-230677 A 11/2013

OTHER PUBLICATIONS

International Search Report, PCT/JP2015/054619, Apr. 21, 2015, 1 pg.

*Primary Examiner* — Juanita D Jackson
(74) *Attorney, Agent, or Firm* — Volpe and Koenig, P.C.

(57) ABSTRACT

A liquid discharge head including first flow channel members, each having discharge holes, pressurizing chambers, first common supply flow channels, and first common recovery flow channels where the first common supply flow channels and first common recovery flow channels are long in a first direction, and the first flow channel members are disposed in a second direction; a second flow channel member having a second common supply flow channel and a second common recovery flow channel; and pressurizing parts to respectively pressurize the liquid in the pressurizing chambers. The second flow channel member is disposed on the first flow channel member. The first flow channel member, second flow channel member, second common supply flow channel, and second common recovery flow channel are long in the second direction. Pressure loss may therefore be minimized in the pressurizing chambers without increasing the size of the liquid discharge head in a planar direction.

20 Claims, 11 Drawing Sheets

(56) References Cited

U.S. PATENT DOCUMENTS

| | | | | |
|---|---|---|---|---|
| 2011/0187773 | A1* | 8/2011 | Kusakari | B41J 2/14233 347/9 |
| 2013/0293641 | A1 | 11/2013 | Essen et al. | |

* cited by examiner

LIQUID DISCHARGE HEAD AND RECORDING DEVICE USING THE SAME

TECHNICAL FIELD

The present invention relates to a liquid discharge head and a recording device using the liquid discharge head.

BACKGROUND ART

As a printing head, for example, a liquid discharge head has conventionally known which carries out various kinds of printings by discharging a liquid onto a recording medium. The liquid discharge head includes, for example, a first flow channel member, a second flow channel member, and a plurality of pressurizing parts. The first flow channel member includes a plurality of discharge holes, a plurality of pressurizing chambers respectively connected to the discharge holes, a plurality of first common supply flow channels that are connected in common to the pressurizing chambers and supply a liquid to the pressurizing chambers, and a plurality of first common recovery flow channels through which the liquid is recovered from the pressurizing chambers. The second flow channel member includes a second common supply flow channel, which is connected in common to the first common supply flow channels, and supplies a liquid to the first common supply flow channels, and a second common recovery flow channel through which the liquid is recovered from the first common recovery flow channels. The pressurizing parts respectively pressurize the liquid in the pressurizing chambers. It has been known to circulate the liquid, including the liquid staying in outer parts, even when no discharge is carried out, in order to restrain occurrence of clogging of the flow channels or the like due to the liquid staying in the first common supply flow channels, the first common recovery flow channels, the second common supply flow channel, the second common recovery flow channel, and the pressurizing chambers (for example, refer to Patent Document 1).

PRIOR ART DOCUMENT

Patent Document

Patent Document 1: Japanese Patent Unexamined Publication No. 2009-143168

SUMMARY OF THE INVENTION

Problems to be Solved by the Invention

The liquid discharge head as described in Patent Document 1 has suffered from the problem that a difference in pressure loss of the liquid supplied to each of the pressurizing chambers connected to the first common supply flow channels becomes large due to a difference in connection position at which the first common supply flow channels are connected to the second common supply flow channel. Similarly, a difference in pressure loss of the liquid supplied to each of the pressurizing chambers connected to the first common supply flow channels becomes larger due to a difference in connection position at which the first common recovery flow channels are connected to the second common recovery flow channel. The term "difference in connection position" denotes a difference in position depending on whether to be connected on the upstream side or the downstream side in the flow direction of the liquid.

In order to cope with the above problems, for example, it is conceivable that a flow channel resistance in the second common supply flow channel and the second common recovery flow channel is decreased by increasing a cross-sectional area of the second common supply flow channel and the second common recovery flow channel. However, there remains the problem that the size of the liquid discharge head in a planar direction is increased by increasing the cross-sectional area of the second common supply flow channel and the second common recovery flow channel.

Means for Solving the Problems

An embodiment of the liquid discharge head of the present invention includes a plurality of first flow channel members, a second flow channel member, and a plurality of pressurizing parts. Each of the first flow channel members has a plurality of discharge holes, a plurality of pressurizing chambers respectively connected to the discharge holes, a plurality of first common supply flow channels connected in common to the pressurizing chambers and configured to supply a liquid to the pressurizing chambers, and a plurality of first common recovery flow channels connected in common to the pressurizing chambers and configured to recover the liquid from the pressurizing chambers. The first common supply flow channels and the first common recovery flow channels are long in a first direction. The first flow channel members are disposed in a second direction being a direction intersecting the first direction. The second flow channel member has a second common supply flow channel connected in common to the first common supply flow channels and configured to supply a liquid to the first common supply flow channels, and a second common recovery flow channel connected in common to the first common recovery flow channels and configured to recover the liquid from the first common recovery flow channels. The pressurizing parts respectively pressurize the liquid in the pressurizing chambers. The second flow channel member is disposed on the first flow channel member. The first flow channel member and the second flow channel member are long in the second direction. The second common supply flow channel and the second common recovery flow channel are also long in the second direction.

An embodiment of the recording device of the present invention includes the liquid discharge head, a transport section to transport a recording medium to the liquid discharge head, and a control section to control the liquid discharge head.

Effect of the Present Invention

With the liquid discharge head of the present invention, the variation in pressure loss generated in the pressurizing chambers is reducible without increasing the size of the liquid discharge head in the planar direction.

EMBODIMENTS FOR CARRYING OUT THE INVENTION

First Embodiment

Figure 1A:
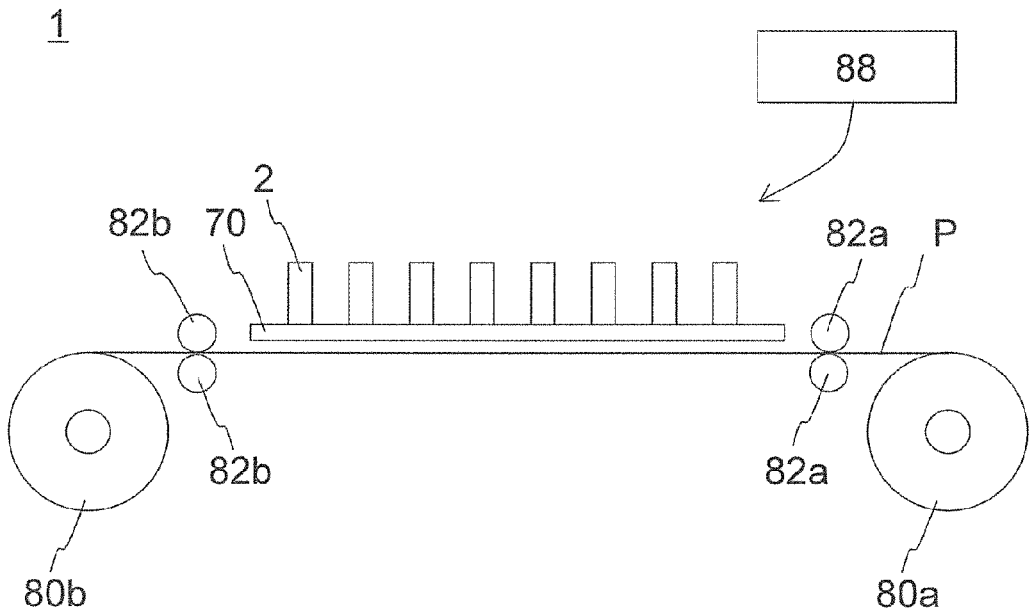
FIG. 1(*a*) is a side view of a recording device including a liquid discharge head according to a first embodiment, and FIG. 1(*b*) is a plan view thereof.
Figure 1B:
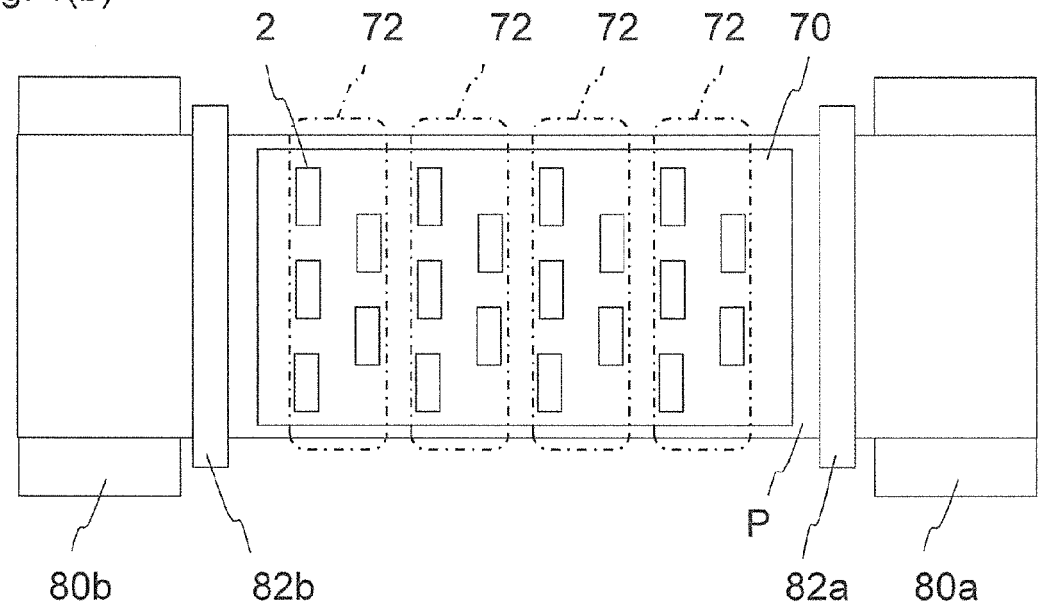

FIG. 1(*a*) is a schematic side view of a printer 1 including a liquid discharge head 2 according to a first embodiment, and FIG. 1(*b*) is a schematic plan view thereof. The printer 1 relatively moves a printing paper P with respect to the liquid discharge head 2 by transporting the printing paper P from a transport roller 80*a* to a transport roller 80*b*. A control section 88 controls the liquid discharge head 2 on the basis of image data and character data so as to cause a liquid to be discharged toward the recording medium P and cause liquid drops to land on the printing paper P, thereby performing recording, such as printing, on the printing paper P.

In the present embodiment, the liquid discharge head 2 is fixed to the printer 1, and the printer 1 is a so-called line printer. Examples of other embodiments of the recording device of the present invention include a so-called serial printer that alternately performs an operation of moving, such as reciprocating, the liquid discharge head 2 in a direction intersecting with, for example, approximately orthogonal to a transport direction of the printing paper P, and a transport of the printing paper P.

A tabular frame 70 is fixed to the printer 1 so as to be approximately parallel to the printing paper P. The frame 70 is provided with twenty holes (not shown), and twenty liquid discharge heads 2 are mounted on their respective corresponding hole portions. Five liquid discharge heads 2 constitute a head group 72. The printer 1 has four head groups 72.

The liquid discharge heads 2 have an elongated shape being long and narrow in a direction from a front side to a rear side in FIG. 1(*a*), namely, a vertical direction in FIG. 1(*b*). The elongated direction is also referred to as a longitudinal direction. Three liquid discharge heads 2 in the head group 72 are disposed along the direction intersecting with, for example, approximately orthogonal to the transport direction of the printing paper P, and the remaining two liquid discharge heads 2 are respectively disposed between the three liquid discharge heads 2 and located at positions deviated from each other along the transport direction. The liquid discharge heads 2 are disposed so that printable ranges respectively the liquid discharge heads 2 are connected to each other in a width direction of the printing paper P, or overlapped with each other via their respective ends. This achieves printing without leaving any blank space in the width direction of the printing paper P.

The four head groups 72 are disposed along the transport direction of the recording paper P. Ink is supplied from a liquid tank (not shown) to each of the liquid discharge heads 2. Inks of the same color are supplied to the liquid discharge heads 2 belonging to the single head group 72, and inks of four colors are printable by the four head groups. The colors of inks to be discharged from the head groups 72 are, for example, magenta (M), yellow (Y), cyan (C), and black (K).

The number of the liquid discharge heads 2 mounted on the printer 1 may be one for printing over the range printable by the single liquid discharge head 2 with a single color. The number of the liquid discharge heads 2 included in the head group 72, or the number of the head groups 72 is suitably changeable according to a printing object and printing conditions. For example, the number of the head groups 72 may be increased in order to perform more multicolor printing. A printing speed, namely, a transport velocity can be increased by disposing the head groups 72 that perform printing with the same color and alternately perform printing in the transport direction. Alternatively, resolution in the width direction of the printing paper P may be enhanced by preparing the head groups 72 that perform printing with the same color, and disposing these head groups 72 with a deviation in the direction intersecting the transport direction.

Besides printing colored inks, a liquid, such as coating agent, may be printed in order to carry out surface treatment of the printing paper P.

The printer 1 performs printing on the printing paper P. The printing paper P is being wound up onto a paper feed roller 80*a*. After the printing paper P passes through between two guide rollers 82*a*, the printing paper P passes under the liquid discharge heads 2 mounted on the frame 70, and then passes through between two transport rollers 82*b*, and is finally recovered onto a recovery roller 80*b*. When performing printing, the printing paper P is transported at a constant velocity and subjected to printing by the liquid discharged heads 2 by rotating the transport rollers 82*b*. The recovery roller 80*b* winds up the printing paper P fed out of the transport rollers 82*b*. The transport velocity is set to, for example, 50 m/min. Each of these rollers may be controlled by the control section 88, or may be manually operated by an operator.

The recording medium may be a cloth besides the printing paper P. The printer 1 may be configured to transport a transport belt instead of the printing paper P. Besides roll-shaped ones, the recording medium may be, for example, sheet papers, cut cloths, wood, or tiles. Further, for example, wiring patterns of electronic devices may be printed by causing a liquid containing conductive particles to be discharged from the liquid discharge heads 2. Furthermore, chemicals may be manufactured by causing a predetermined amount of each of a liquid chemical agent and a liquid containing a chemical agent to be discharged from the liquid discharge heads 2 toward a reaction vessel or the like, followed by a reaction therebetween.

For example, a position sensor, a velocity sensor, and a temperature sensor may be attached to the printer 1, and the control section 88 may control components of the printer 1 according to states of the components of the printer 1, which are revealed from information from these sensors. In particular, when discharge characteristics (such as a discharge rate and a discharge velocity) of the liquid to be discharged from the liquid discharge head 2 are subject to external influence, a drive signal for discharging the liquid in the liquid discharge head 2 needs to changed according to a temperature of the liquid discharge head 2, a temperature of the liquid in the liquid tank, and a pressure being applied to the liquid discharge head 2 by the liquid in the liquid tank.

The liquid discharge head 2 according to the first embodiment is described below with reference to FIGS. 2 to 8. In FIGS. 5 and 7, for the purpose of further clarification of the drawings, the flow channels and the like, which are located below others and therefore should be drawn by a dashed line, are drawn by a solid line. In FIG. 8(*a*), an equivalent circuit schematic of the liquid discharge head 2 is shown in a simplified form.

Here, a first direction D1 is an extending direction of the first common supply flow channel 20 and a first common recovery flow channel 24. A second direction D2 is an extending direction of the second common supply flow channel 22 and a second common recovery flow channel 26. A third direction D3 is a direction orthogonal to the second direction D2.

Figure 2:
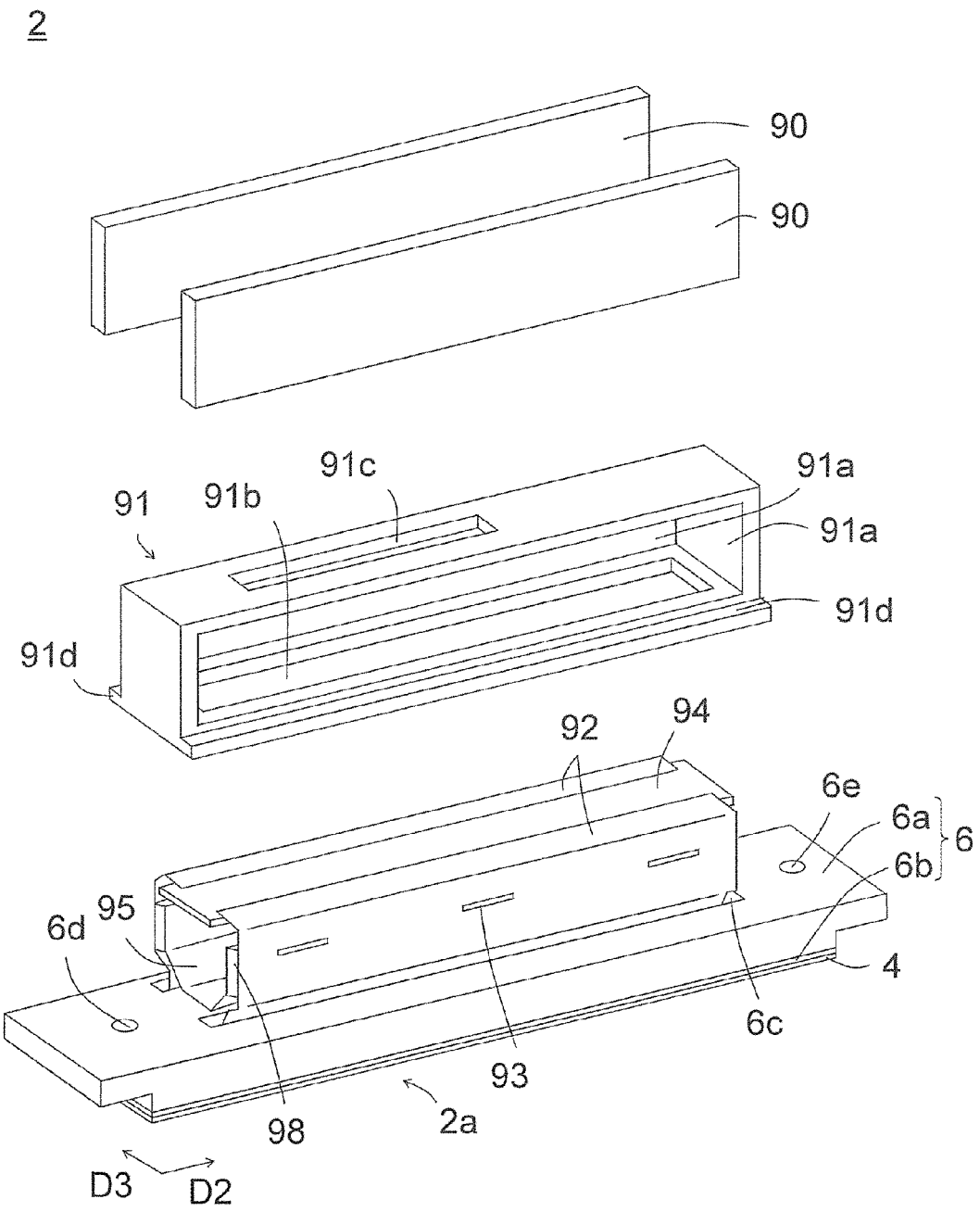
FIG. 2 is an exploded perspective view of the liquid discharge head according to the first embodiment.
Figure 3A:
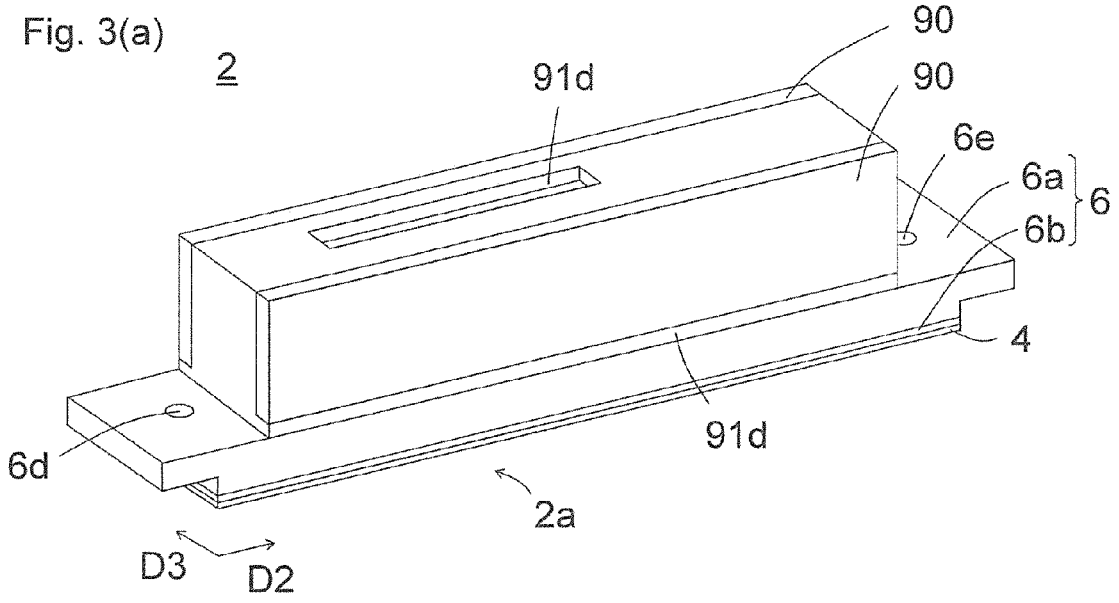
FIG. 3(*a*) is a perspective view of the liquid discharge head in FIG. 2, and FIG. 3(*b*) is a sectional view thereof.
Figure 3B:
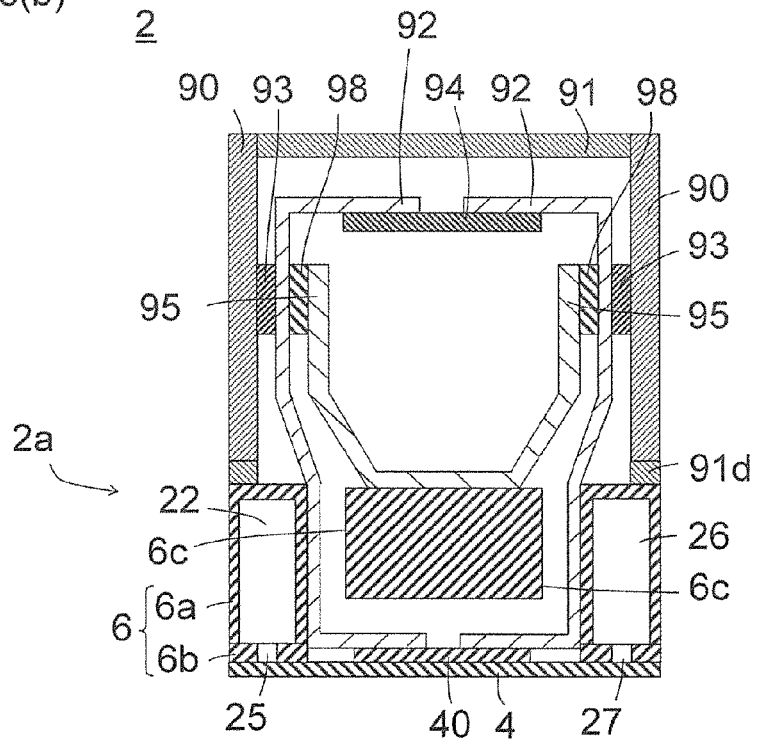

As shown in FIG. 2, the liquid discharge head 2 includes a heat sink 90, a casing 91, a head body 2*a*, a signal transmission section 92, a driver IC 93, a wiring board 94, a pressing member 95, and an elastic member 98. The liquid discharge head 2 needs to include the head body 2*a*, and does not necessarily include the heat sink 90, the casing 91, the signal transmission section 92, the driver IC 93, the wiring board 94, the pressing member 95, and the elastic member 98.

In the liquid discharge head 2, the signal transmission section 92 is led from the head body 2*a*, and the signal transmission section 92 is electrically connected to the wiring board 94. The driver IC 93 that controls driving of the liquid discharge head 2 is disposed on the signal transmission section 92. The driver IC 93 is pressed against the heat sink 90 by the pressing member 95 with the elastic member 98 interposed therebetween. A support member to support the wiring board 94 is omitted from the drawing.

The heat sink 90 can be made from metal or an alloy, and is disposed for releasing heat of the driver Ic 93 to the outside. The heat sink 90 is joined to the casing 91 by a screw or adhesive.

The casing 91 includes two first openings 91*a*, a second opening 91*b*, a third opening 91*c*, and a heat insulating part 91*d*. The two first openings 91*a* are disposed so as to face each other in the third direction D3. Two heat sinks 90 are respectively disposed on the two first openings 91*a*. The second opening 91*b* opens downward, and the wiring board 94 and the pressing member are disposed with the second opening 91*b* interposed therebetween in the casing 91. The third opening 91*c* opens upward and accommodates therein a connector (not shown) disposed on the wiring board 94. The heat insulating part 91*d* is disposed so as to extend in the second direction D2, and is disposed between the heat sink 90 and the head body 2*a*. This makes it possible to minimize the likelihood that the heat released to the heat sink 90 is transmitted to the head body 2*a*. The casing 91 can be formed of metal, an alloy, or a resin.

Figure 4A:
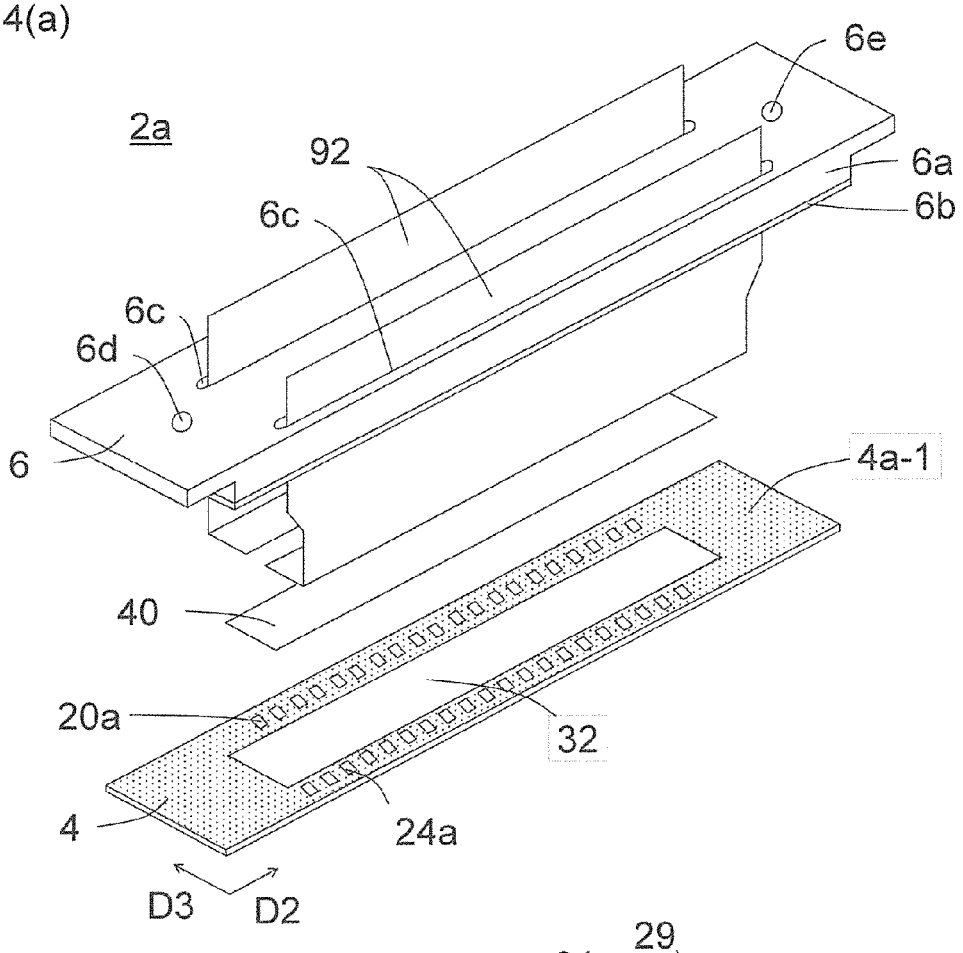
FIG. 4(*a*) is an exploded perspective view of a head body, and FIG. 4(*b*) is an exploded perspective view of a second flow channel member.
Figure 4B:
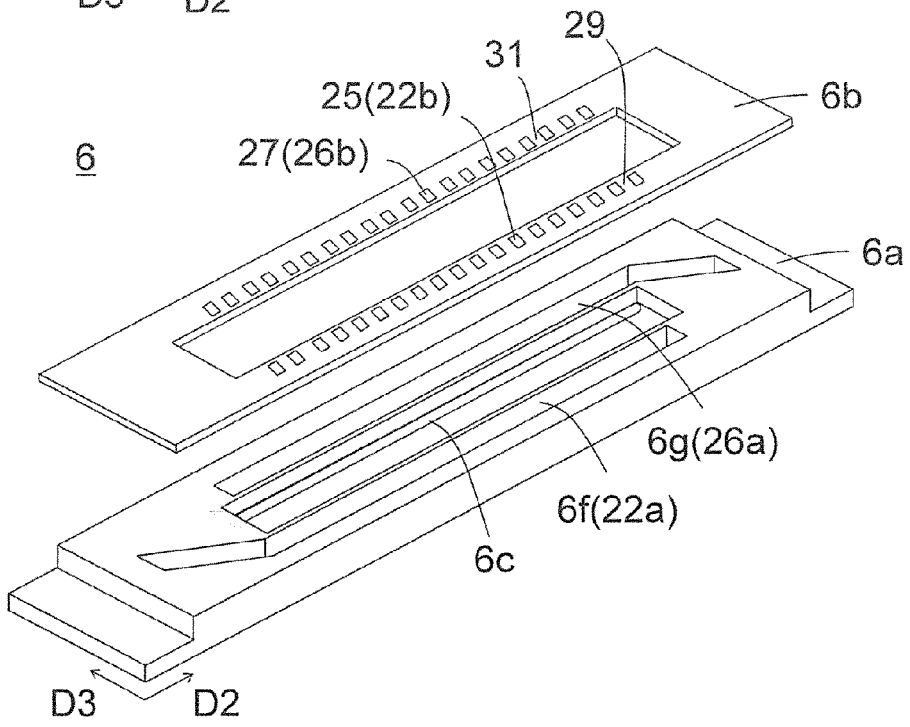
Figure 5:
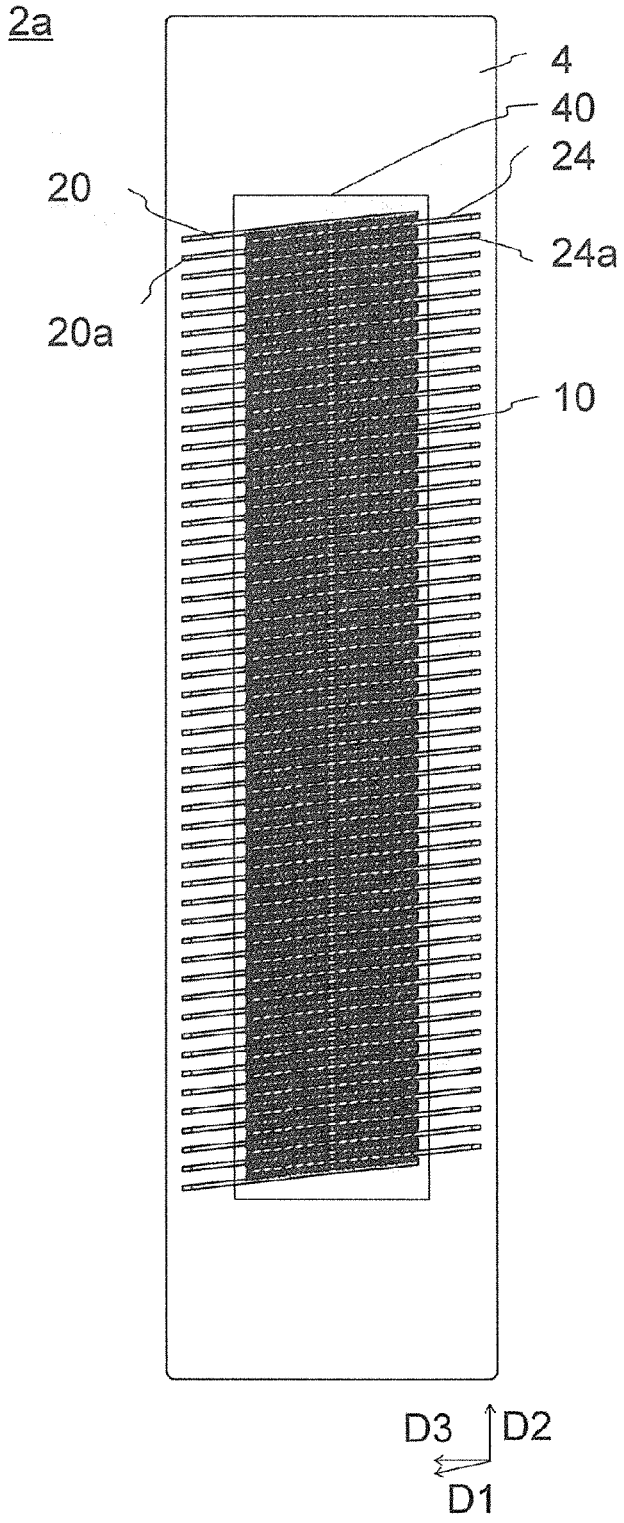
FIG. 5 is a plan view of the head body.

As shown in FIG. 4, the head body 2*a* has a tabular shape that is long in the second direction D2, and has a first flow channel member 4, a second flow channel member 6, and a piezoelectric actuator substrate 40. In the head body 2*a*, the piezoelectric actuator substrate 40 and the second flow channel member 6 are disposed on the first flow channel member 4. The signal transmission section 92 is connected to the piezoelectric actuator substrate 40, and the signal transmission section 92 is drawn upward through an opening 6*c* of the second flow channel member 6.

The piezoelectric actuator substrate 40 is disposed in a mounting region 32 located at a central part of the first flow channel member 4. The piezoelectric actuator substrate 40 is disposed for pressurizing a plurality of pressurizing chambers (refer to FIG. 4(*a*)) disposed in the first flow channel member 4.

The first flow channel member 4 forms a flow channel therein, and has first supply openings 20*a* and first recovery openings 24*a* on a first main surface 4*a*-1 (refer to FIGS. 4 and 7(*b*)). The first supply openings 20*a* are disposed along the second direction D2, and are disposed on one end in the third direction D3. The first recovery openings 24*a* are disposed along the second direction D2, and are disposed on the other end in the third direction D3. The first supply openings 20*a* and the first recovery openings 24*a* are disposed on both sides of the mounting region 32 in the third direction D3.

The second flow channel member 6 is disposed on an outer peripheral part of the first main surface 4*a*-1 in the first flow channel member 4. A joint region between the first flow channel member 4 and the second flow channel member 6 is indicated by dots in FIG. 4(*a*). The second flow channel member 6 has a first member 6*a* and a second member 6*b*. The first member 6*a* is disposed on the second member 6*b* and is joined to the second member 6*b* with an adhesive (not shown).

The first member 6*a* has a through hole 6*c*, an opening 6*d*, an opening 6*e*, a groove 6*f*, an a groove 6*g*. The through hole 6*c* is disposed so as to extend through the first member 6*a* and configured to accept the signal transmission section 92 inserted therethrough. The opening 6*d* is disposed on an upper surface of the first member 6*a* and configured to externally supply a liquid therethrough to the second flow channel member 6. The opening 6*e* is disposed on the upper surface of the first member 6*a* and configured to recover the liquid therethrough from the second flow channel member 6 to the outside.

The groove 6*f* is disposed on a lower surface of the first member 6*a* and is communicated with the opening 6*d*. The groove 6*g* is disposed on a lower surface of the first member 6*a* and is communicated with the opening 6*e*. The groove 6*f* is covered with the second member 6*b*, and the groove 6*f* and the second member 6*b* form a second common supply flow channel body 22*a*. The groove 6*g* is covered with the second member 6*b*, and the groove 6*g* and the second member 6*b* form a second common recovery flow channel body 26*a*.

The second member 6*b* has second supply openings 25 and second recovery openings 27. The second supply openings 25 are disposed along the second direction D2, and are disposed on one end in the third direction D3. The second recovery openings 27 are disposed along the second direction D2, and are disposed on the other end in the third direction D3. The second supply openings 25 is communicated with the groove 6*f* of the first member 6*a*, and form a supply connection flow channel 22*b*. Each of the second recovery openings 27 is communicated with the groove 6*g* of the first member 6*a*, and forms a recovery connection flow channel 26*b*. Although through holes corresponding to the through holes 6*c* of the first member 6*a* are disposed, they are omitted from FIG. 3(*b*).

The second flow channel member 6 is formed long in the second direction D2, and has therein the second common supply flow channel 22 and the second common recovery flow channel 26. The second common supply flow channel 22 has a second common supply flow channel body 22*a* and supply connection flow channels 22*b*. The second common supply flow channel body 22*a* is formed long in the second direction D2. The supply connection flow channels 22*b* connect the second common supply flow channel body 22*a* and the second supply openings 25.

The supply connection flow channels 22*b* are disposed in the second direction D2. The second member 6*b* includes a partition member 29. The supply connection flow channels 22*b* adjacent to each other are partitioned by the partition member 29. The partition member 29 is disposed in a joint region with respect to the first flow channel member 4. The first flow channel member 4 and the second flow channel member 6 are joined together with the partition member 29 interposed therebetween.

The second common recovery flow channel 26 has a second common recovery flow channel body 26*a* and recovery connection flow channels 26*b*. The second common recovery flow channel body 26*a* is formed long in the second direction D2. The recovery common flow channels 26*b* connect the second common recovery flow channel body 26*a* and the second recovery openings 27.

The recovery connection flow channels 26*b* are disposed in the second direction D2. The second member 6*b* includes a partition member 31. The recovery connection flow channels 26*b* adjacent to each other are partitioned by the partition member 31. The partition member 31 is disposed in a joint region with respect to the first flow channel member 4. The first flow channel member 4 and the second flow channel member 6 are joined together with the partition member 31 interposed therebetween.

With the foregoing configuration, the liquid supplied from the outside to the opening 6*d* is supplied to the second common supply flow channel 22 in the second flow channel member 6. The liquid flows through the second supply opening 25 into the first common supply flow channel 20, and the liquid is then supplied to the first flow channel member 4. Subsequently, the liquid recovered by the first common recovery flow channel 24 flows through the second recovery opening 27 into the second common recovery flow channel 26, and the liquid is then recovered through the opening 6*e* to the outside.

Figure 6:
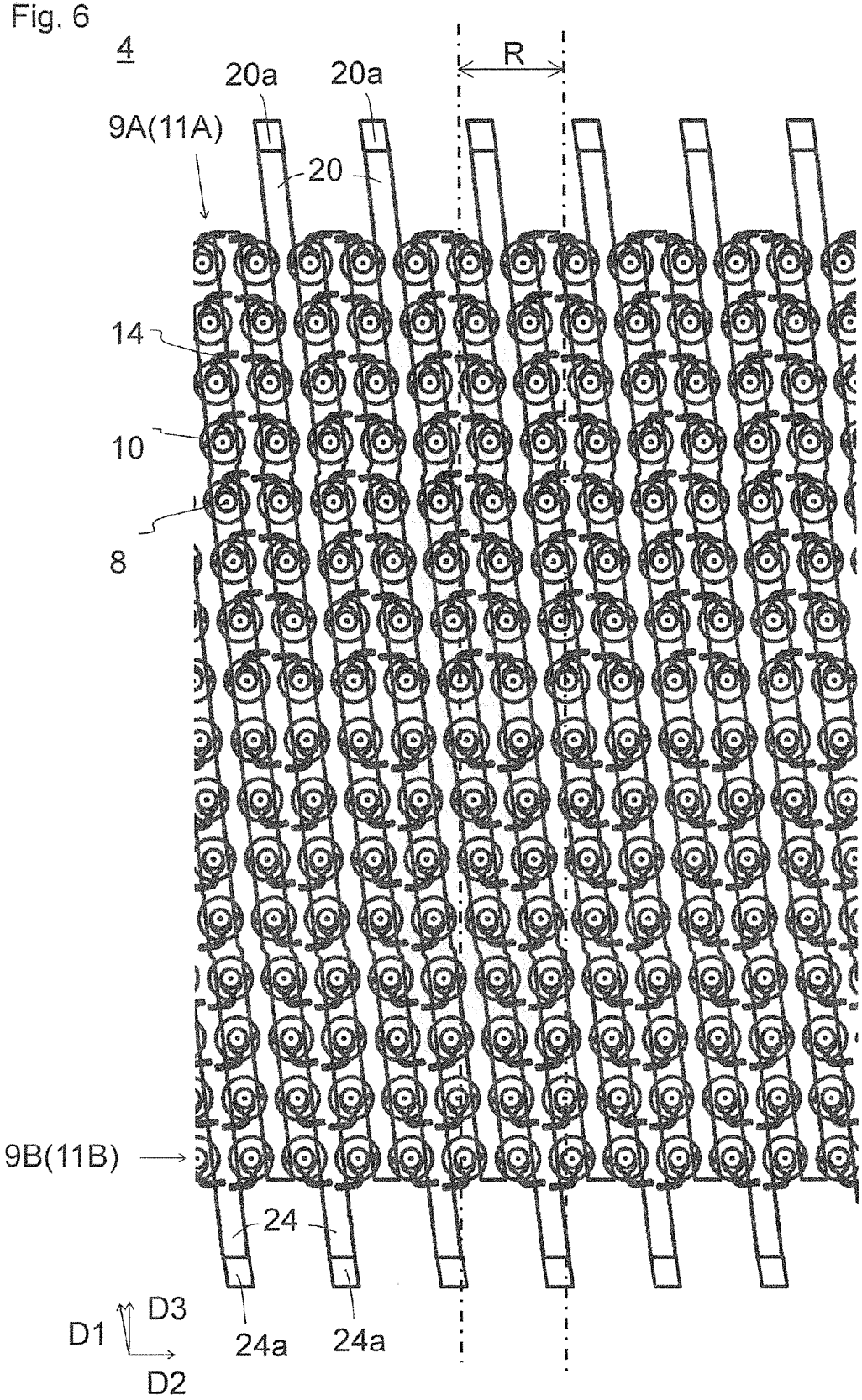
FIG. 6 is a plan view showing in enlarged dimension a part of FIG. 5.
Figure 7A:
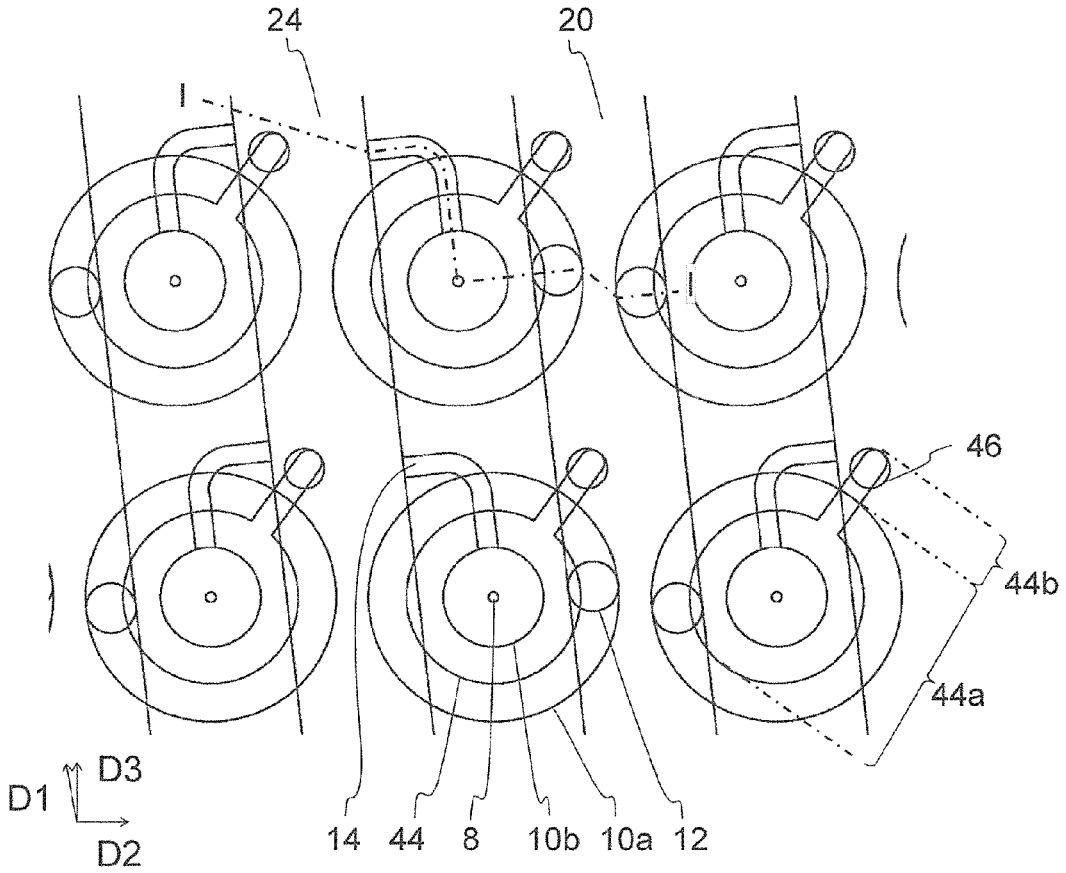
FIG. 7(*a*) is a plan view showing in enlarged dimension a main part, and FIG. 7(*b*) is a sectional view taken along line I-I in FIG. 7(*a*)
Figure 7B:
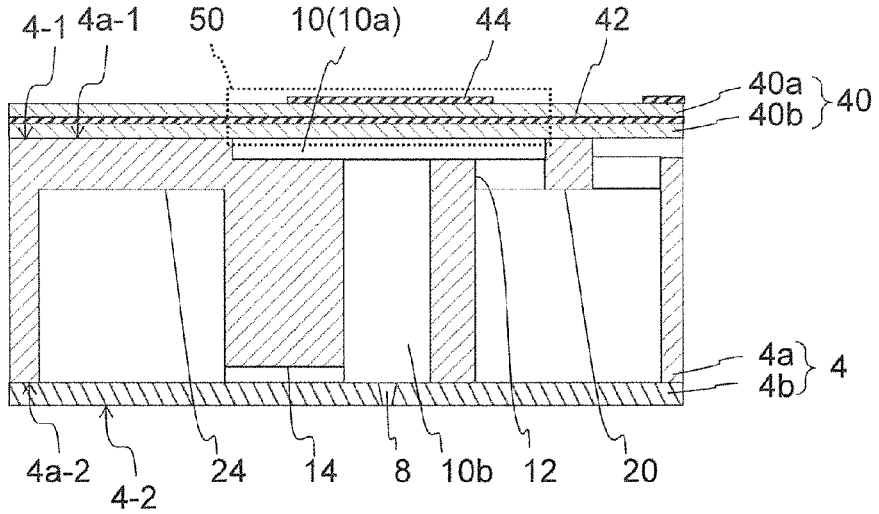
Figure 8A:
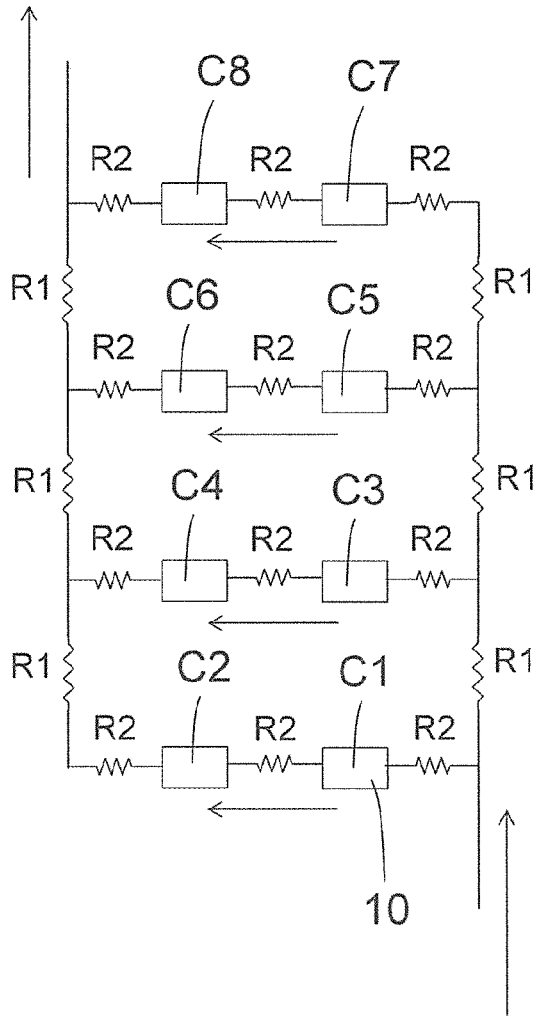
FIG. 8(*a*) is an equivalent circuit schematic showing the liquid discharge head in a simplified form, and FIG. 8(*b*) is a graph that shows pressure loss of each pressurizing chamber.
Figure 8B:
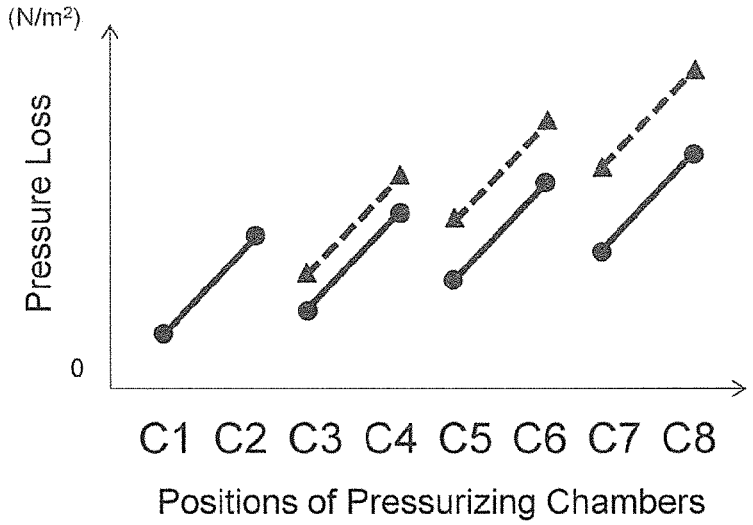

As shown in FIGS. 5 to 7, the first flow channel member 4 has a flow channel member body 4*a* and a nozzle plate 4*b*. The first flow channel member 4 has a pressurizing chamber surface 4-1 configured to mount the piezoelectric actuator substrate 40 thereon, and a discharge hole surface 4-2 into which discharge holes 8 open. The discharge holes 8 are formed in a matrix form on the nozzle plate 4*b*. The flow channel member body 4*a* is provided with the pressurizing chamber 10, the first flow channel 12, the second flow channel 14, the first common supply flow channel 20, and the first common recovery flow channel 24.

The first flow channel member body 4*a* has a first main surface 4*a*-1 and a second main surface 4*a*-2 located on the opposite side of the first main surface 4*a*-1. The piezoelectric actuator substrate 40 is joined to the first main surface 4*a*-1. The first main surface 4*a*-1 is in the same plane as the pressurizing chamber surface 4-1. The nozzle plate 4*b* is joined to the second main surface 4*a*-2. The nozzle plate 4*b* is disposed so that the discharge hole 8 is communicated with the pressurizing chamber 10 of the flow channel member body 4*a*. The first flow channel member 4 may be formed by laminating metal or resin plates one upon another.

The pressurizing chamber 10 has a pressurizing chamber body 10*a* and a partial flow channel 10*b*. The pressurizing chamber body 10*a* has a circular shape in a plan view, and the partial flow channel 10*b* extends downward from a center of the pressurizing chamber body 10*a*. The pressurizing chamber body 10*a* is configured to apply a pressure to the liquid in the partial flow channel 10*b* by being subjected to a pressure from a displacement element 50 disposed on the pressurizing chamber body 10*a*.

The pressurizing chamber body 10*a* is in the shape of a right circular cylinder, whose planar shape is a circular shape. Owing to the fact that the planar shape is the circular shape, it is possible to increase displacement and volume change of the pressurizing chamber 10 caused by the displacement. The partial flow channel 10*b* is in the shape of a right circular cylinder having a smaller diameter than the pressurizing chamber body 10*a*, and a planar shape of the partial flow channel 10*b* is a circular shape. The partial flow channel 10*b* is disposed at such a position that allows the partial flow channel 10*b* to be accommodated in the pressurizing chamber body 10*a* when viewed from the pressurizing chamber surface 4-1.

The partial flow channel 10*b* may be in the shape of a cone or circular truncated cone whose cross-sectional area decreases toward the discharge hole 8. This makes it possible to increase a width of the first common supply flow channel 20 and the first common recovery flow channel 24, thereby minimizing the foregoing difference in pressure loss.

The first common supply flow channels 20 and the first common recovery flow channels 24 are disposed on the first flow channel member 4 so as to be long in the first direction D1. That is, the first common supply flow channels 20 and the first common recovery flow channels 24 are disposed so as to extend along the first direction D1. The first common supply flow channels 20 and the first common recovery flow channels 24 are disposed are also disposed in the second direction D2. Specifically, the first common supply flow channels 20 and the first common recovery flow channels 24 are alternately disposed side by side in the second direction D2.

The pressurizing chambers 10 are disposed along both sides of the first common supply flow channel 20, and constitute a total of two pressurizing chamber columns 11A, a column on each side. The first common supply flow channel 20 and the pressurizing chambers 10 disposed side by side on both sides of the first common supply flow channels 20 are connected to one another through the first flow channel 12. A first supply opening 20*a* is connected to one end of the first common supply flow channel 20.

The pressurizing chambers 10 are also disposed along both sides of the first common recovery flow channel 24, and constitute a total of two pressurizing chamber columns 11A, a column on each side. The first common supply flow channels 20 and the pressurizing chambers 10 disposed side by side on both sides of the first common supply flow channels 20 are connected to one another through the second flow channel 14. A first recovery opening 24*a* is connected to one end of each of the second recovery flow channels 24.

The pressurizing chambers 10 constitute the pressurizing chamber columns 11A along the first direction D1, and constitute the pressurizing chamber rows 11B along the second direction D2. The discharge holes 8 are located at the center of their respective corresponding pressurizing chambers 10. Similarly to the pressurizing chambers 10, the discharge holes 8 constitute discharge hole columns 9A along the first direction D1, and constitute discharge hole rows 9B along the second direction D2.

An angle formed by the first direction D1 and the second direction D2 is deviated from right angles. Therefore, the discharge holes 8 belonging to one discharge hole column 9A disposed along the first direction D1 are disposed in the second direction D2 with a deviation corresponding to an amount of the deviation from the right angles. The discharge hole columns 9A are disposed side by side in the second direction D2. Hence, the discharge holes 8 belonging to another discharge hole column 9A are accordingly disposed with the deviation in the second direction D2. A combination of these ensures that the discharge holes 8 of the first flow channel member 4 are disposed at certain intervals in the second direction D2. It is therefore possible to perform printing so that a predetermined range is filled with pixels to be formed by the discharged liquid.

In FIG. 6, when the discharge holes 8 are projected in the third direction D3, 32 discharge holes 8 are projected in a range of a virtual straight line R, and the discharge holes 8 are disposed at intervals of 360 dpi within the virtual straight line R. This makes it possible to perform printing at a resolution of 360 dpi by transporting the printing paper P in the direction orthogonal to the virtual straight line R, followed by printing.

With the foregoing configuration, in the first flow channel member 4, the liquid supplied through the first supply opening 20*a* into the first common supply flow channel 20 flows through the first flow channel 12 into the pressurizing chambers 10 disposed along the first common supply flow channel 20, and a part of the liquid is discharged from the discharge hole 8. With respect to the pressuring chambers 10, the remaining liquid flows through the second flow channel 14 into the first common recovery flow channel 24, and is then discharged from the first flow channel member 4 to the outside through the first recovery opening 24*a*.

The piezoelectric actuator substrate 40 has a laminate structure formed of two piezoelectric ceramic layers 40*a* and 40*b* that are piezoelectric bodies. Each of these piezoelectric ceramic layers 40*a* and 40*b* has a thickness of approximately 20 μm. Both of the piezoelectric ceramic layers 40*a* and 40*b* extend across the pressurizing chambers 10.

These piezoelectric ceramic layers 40*a* and 40*b* are formed of, for example, lead zirconate titanate (PZT) based, $NaNbO_3$ type, $BaTiO_3$ type, $(BiNa)NbO_3$ type, or $BiNaNb_5O_{15}$ type ceramic material, each having ferroelectricity. The piezoelectric ceramic layer 40*b* operates as a vibrating plate, and does not necessarily need to be the piezoelectric body. Alternatively, other ceramic layer and a metal plate, which are not the piezoelectric body, may be used.

The piezoelectric actuator substrate 40 has a common electrode 42 formed of an Ag—Pd based metal material or the like, and an individual electrode 44 formed of an Au type metal material or the like. As described above, the individual electrode 44 includes an individual electrode body 44*a* disposed at a position opposed to the pressurizing chamber 10 on the upper surface of the piezoelectric actuator substrate 40, and an extraction electrode 44*b* being extracted from the individual electrode body 44*a*. A connection electrode 46 is formed at a portion of one end of the extraction electrode 44*b* which is extracted beyond a region opposed to the pressurizing chamber 10. The connection electrode 46 is formed of, for example, silver-palladium containing glass frit, and is formed in a convex shape with a thickness of approximately 15 μm. The connection electrode 46 is electrically connected to an electrode disposed on the signal transmission section 60.

The common electrode 42 is formed approximately over the entire surface in a planar direction in a region between the piezoelectric ceramic layer 40*a* and the piezoelectric ceramic layer 40*b*. That is, the common electrode 42 is extended to cover all the pressurizing chambers 10 in a region opposed to the piezoelectric actuator substrate 40. The common electrode 42 has a thickness of approximately 2 μm. The common electrode is connected through, a via hole formed in and extending through the piezoelectric ceramic layer 40*a*, to a surface electrode for a common electrode which is formed at a position to avoid the electrode groups of the individual electrodes 44 on the piezoelectric ceramic layer 40*a*. The common electrode 42 is grounded and held at ground potential. Similarly to a large number of the individual electrodes 44, the surface electrode for the common electrode is directly or indirectly connected to the control section 88.

A portion of the piezoelectric ceramic layer 40*a* which is sandwiched between the individual electrode 44 and the common electrode 42 is polarized in a thickness direction, and is formed into a displacement element 50 having a unimolf structure which is displaced upon application of a voltage to the individual electrode 44.

The piezoelectric actuator substrate 40 including the displacement elements 50 is joined to the upper surface of the first flow channel member 4, and the displacement elements 50 are respectively disposed so as to locate on the pressurizing chambers 10. The piezoelectric actuator substrate 40 occupies a region having approximately the same shape as the pressurizing chamber group formed of the pressuring chambers 10. Openings of the pressurizing chambers 10 are closed by joining the piezoelectric actuator substrate 40 to the pressurizing chamber surface 4-1 of the first flow channel member 4. Similarly to the head body 2*a*, the piezoelectric actuator substrate 40 has a rectangular shape that is long in the second direction D2.

A signal transmission section 92, such as an FPC, for supplying signals to the displacement elements 50 is connected to the piezoelectric actuator substrate 40. The second flow channel member 6 has the through hole 6*c* that penetrates vertically in the center thereof. The signal transmission section 92 is electrically connected via the through hole 6*c* to the control section 88.

A liquid discharge operation is described below. The displacement element 50 is displaced by a drive signal supplied through a driver IC to the individual electrode 44 under the control of the control section 88. As a driving method, a so-called pull ejection driving can be employed.

FIG. 8(*a*) shows, in a simplified form, an equivalent circuit of the liquid discharge head 2, in which C1 to C8 indicate the pressurizing chambers 10 (refer to FIG. 7), R1 indicates a flow channel resistance in each of the second common supply flow channel 22 and the second common recovery flow channel 26, and R2 indicates a flow channel resistance in each of the first common supply flow channel 20 and the first common recovery flow channel 24. FIG. 8(*b*) shows a pressure loss of a liquid supplied to the pressurizing chambers C1 to C8, in which a broken line indicates a conventional liquid discharge head, and a solid line indicates the liquid discharge head 2 according to the first embodiment.

The first common supply flow channels 20 are connected in parallel to the second common supply flow channel 22. The first common recovery flow channels 24 are connected in parallel to the second common recovery flow channel 26. The pressurizing chambers C1 and C2 connected to the same first common supply flow channel 20 and the same first common recovery flow channel 24 are connected in series.

The pressure loss of the liquid supplied to the pressurizing chamber C1 is R2, and the pressure loss of the liquid supplied to the pressurizing chamber C2 is 2×R2. The pressure loss of the liquid supplied to the pressurizing chamber C3 is R1+R2. The pressure loss of the liquid supplied to the pressurizing chamber C4 is R1+2×R2. The pressure loss of the liquid supplied to the pressurizing chamber C5 is 2×R1+R2. The pressure loss of the liquid supplied to the pressurizing chamber C6 is 2×R1+2×R2. The pressure loss of the liquid supplied to the pressurizing chamber C7 is 3×R1+R2. The pressure loss of the liquid supplied to the pressurizing chamber C8 is 3×R1+2×R2.

Thus, the pressure loss of the liquid supplied to the pressurizing chamber C1 located on the most upstream side in a liquid flow direction is R2, and the pressure loss of the liquid supplied to the pressurizing chamber C8 located on the most downstream side in the liquid flow direction is 3×R1+2×R2. Therefore, as shown in FIG. 8(*b*), variations may occur in the pressure loss of the liquid supplied to the pressurizing chambers 10 depending on connection positions at which the first common supply flow channel 20 and the first common recovery flow channel 24 are respectively connected to the second common supply flow channel 22 and the second common recovery flow channel 26.

In a no-discharge state, a meniscus of the liquid is retained in each of the discharge holes 8. The liquid is at a negative pressure in the discharge hole 8. This comes into balance with a surface tension of the liquid, so that the meniscus is retained. The liquid may overflow at a large positive pressure. The liquid may be drawn into the first flow channel member 4 at a large negative pressure, thus failing to maintain a liquid dischargeable state. It is therefore necessary to avoid that the pressure difference of the liquid in the discharge hole 8 becomes excessively large when the liquid is allowed to flow from the first common supply flow channel 20 to the first common recovery flow channel 24.

As to the liquid supplied to the pressurizing chambers 10, the variations in the pressure loss of the liquid supplied to the pressurizing chambers 10 need to be reduced in order to retain the meniscus of the discharge holes 8 (refer to FIG. 7). One way to reduce the variations in the pressure loss of the liquid supplied to the pressurizing chambers 10 is to decrease the value of the flow channel resistance R1 or the flow channel resistance R2.

One way to reduce the variations in the pressure loss of the liquid supplied to the pressurizing chambers 10 is to decrease the flow channel resistance R2 of each of the first common supply flow channel 20 and the first common recovery flow channel 24. One way to decrease the flow channel resistance R2 of each of the common supply flow channel 20 and the first common recovery flow channel 24 is to increase a cross-sectional area of each of the first common supply flow channel 20 and the first common recovery flow channel 24. The first flow channel member 4 becomes larger in the planar direction by increasing the cross-sectional area of the first common supply flow channel 20 and the first common recovery flow channel 24. Enlargement of the first flow channel member 4 in the planar direction may deteriorate rigidity of the first flow channel member 4 and also increase a distance between the discharge holes 8, and there is a risk that an adverse effect is exerted on liquid discharge accuracy.

One way to reduce the risk is to decrease the flow channel resistance R1 of each of the second common supply flow channel 22 and the second common recovery flow channel 26. One way to decrease the flow channel resistance R1 in the second common supply flow channel 22 and the second common recovery flow channel 26 is to increase a cross-sectional area of each of the second common supply flow channel 22 and the second common recovery flow channel 26. However, when a width of each of the second common supply flow channel 22 and the second common recovery flow channel 26 in a plan view is increased in order to increase the cross-sectional area of the second common supply flow channel 22 and the second common recovery flow channel 26, it follows that the size of the liquid discharge head 2 in the planar direction becomes larger. It is also difficult to decrease the distance between the liquid discharge heads 2 when a printer is configured by using the liquid discharge heads 2, thereby exerting an adverse effect on printing accuracy.

While in the liquid discharge head 2, the second flow channel member 6 is disposed on the first flow channel member 4, the first flow channel member 4 and the second flow channel member 6 are long in the second direction D2, and the second common supply flow channel 22 and the second common recovery flow channel 26 are also long in the second direction D2. It is therefore possible to increase the cross-sectional area of each of the second common supply flow channel 22 and the second common recovery flow channel 26 without increasing the size of the liquid discharge head 2 in the planar direction. This makes it possible to reduce the flow channel resistance R1 in the second common supply flow channel 22 and the second common recovery flow channel 26. It is consequently possible to minimize the likelihood that the liquid discharge head 2 is enlarged in the planar direction, while reducing the variations in pressure loss that can occur in the pressurizing chambers 10.

Further, the liquid discharge head 2 has a configuration that the cross-sectional area of the second common supply flow channel 22 is larger than the cross-sectional area of the first common supply flow channel 20, and the cross-sectional area of the second common recovery flow channel 26 is larger than the cross-sectional area of the first common recovery flow channel 24. It is therefore possible to reduce the variations in the pressure loss that can occur in the first common supply flow channel 20 and the first common recovery flow channel 24 by reducing the pressure loss that can occur in the second common supply flow channel 22 and the second common recovery flow channel 26. It is consequently possible to reduce the variations in the pressure loss that can occur in the pressurizing chambers 10.

In the liquid discharge head 2, the flow channel resistance R1 in the second common supply flow channel 22 is 1/100 or less of the flow channel resistance R2 in the first common supply flow channel 20, and the flow channel resistance R1 in the second common recovery flow channel 26 is 1/100 or less of the flow channel resistance R2 in the first common recovery flow channel 24. It is therefore possible to reduce the variations in the pressure loss that can occur in the first common supply flow channel 20 and the first common recovery flow channel 24 by reducing the pressure loss that can occur in the second common supply flow channel 22 and the second common recovery flow channel 26. It is consequently possible to reduce the variations in the pressure loss that can occur in the pressurizing chambers 10.

The liquid discharge head 2 also has a configuration that the piezoelectric actuator substrate 40 is disposed at a central part on the first flow channel member 4, and the second flow channel member 6 is disposed on an outer peripheral part on the first flow channel member 4 in a plan view from the second flow channel member 6. Therefore, even when the first flow channel member 4 vibrates due to deformation of the displacement element 50, the vibration of the first flow channel member 4 is reducible because the second flow channel member 6 fixes the first flow channel member 4 along the outer peripheral part located outside the piezoelectric actuator substrate 40.

The liquid discharge head 2 further includes the signal transmission section 92 that transmits a signal for driving the piezoelectric actuator substrate 40. An electrical connection between the signal transmission section 92 and the piezoelectric actuator substrate 40 is protectable by the second flow channel member 6.

The through holes 6*c* vertically extend through the second flow channel member 6, and the through holes 6*c* are configured to accept the signal transmission sections 92 inserted therethrough. Therefore, corner parts of each of the openings of the through holes 6*c* are preferably subjected to C-chamfering or R-chamfering. This contributes to minimizing the likelihood of damage to the signal transmission sections 92.

The liquid discharge head 2 also has a configuration that the second common supply flow channel 22 is disposed on one end in the third direction D3 in the first flow channel member 4, and the second common recovery flow channel 26 is disposed on the other end in the third direction D3 in the first flow channel member 4 in the plan view from the second flow channel member 6.

It is therefore possible to increase the cross-sectional area of each of the second common supply flow channel 22 and the second common recovery flow channel 26. The second flow channel member 6 is capable of fixing the outer peripheral part of the first flow channel member 4, thus leading to enhanced rigidity.

In the liquid discharge head 2, the second flow channel member 6 is joined to the first flow channel member 4. The second common supply flow channel 22 includes the second common supply flow channel body 22*a* that is long in the second direction D2, and the supply connection flow channels 22*b* to connect the second common supply flow channel body 22*a* and the first common supply flow channel 20. The supply connection flow channels 22*b* respectively have the partition members 29. The partition members 29 are configured to include a joint region between the first flow channel member 4 and the second flow channel member 6. In other words, the partition members 29 are disposed on the joint region between the first flow channel member 4 and the second flow channel member 6. This makes it possible to enhance the rigidity of the second flow channel member 6 located above the joint region, thus leading to a strong joint between the first flow channel member 4 and the second flow channel member 6.

Similarly to the above, the second common recovery flow channel 26 includes the second common recovery flow channel body 26*a* that is long in the second direction D2, and the recovery connection flow channels 26*b* to connect the second common recovery flow channel body 26*a* and the first common recovery flow channel 24. The recovery connection flow channels 22*b* respectively have the partition members 31. The partition members 31 are configured to include the joint region between the first flow channel member 4 and the second flow channel member 6. In other words, the partition members 31 are disposed on the joint region between the first flow channel member 4 and the second flow channel member 6. This makes it possible to enhance the rigidity of the second flow channel member 6 located above the joint region, thus leading to the strong joint between the first flow channel member 4 and the second flow channel member 6.

The first common recovery flow channels 24 are respectively disposed on both sides of the first common supply flow channel 20, and the first common supply flow channels 20 are respectively disposed on both sides of the first common recovery flow channel 24. Thus, the single first common supply flow channel 20 and the single first common recovery flow channel 24 are connected to the single pressurizing chamber column 11A. Therefore, the number of the first common supply flow channels 20 and the first common recovery flow channels 24 can be reduced to approximately half of that in the case where another first common supply flow channel 20 and another first common recovery flow channel 24 are connected to another pressurizing chamber column 11A. Hence, the first common supply flow channels 20 and the first common recovery flow channels 24 can be disposed with satisfactory area efficiency.

The second flow channel member 6 is preferably formed thicker than the first flow channel member 4, and preferably has a thickness of approximately 5-30 mm. This makes it possible to increase the cross-sectional area of each of the second common supply flow channel 22 and the second common recovery flow channel 26. A thickness of the first flow channel member body 4*a* is preferably approximately 500 μm to 2 mm. This prevents excessively high rigidity and reduces the likelihood of adverse effects on discharge.

Second Embodiment

Figure 9A:
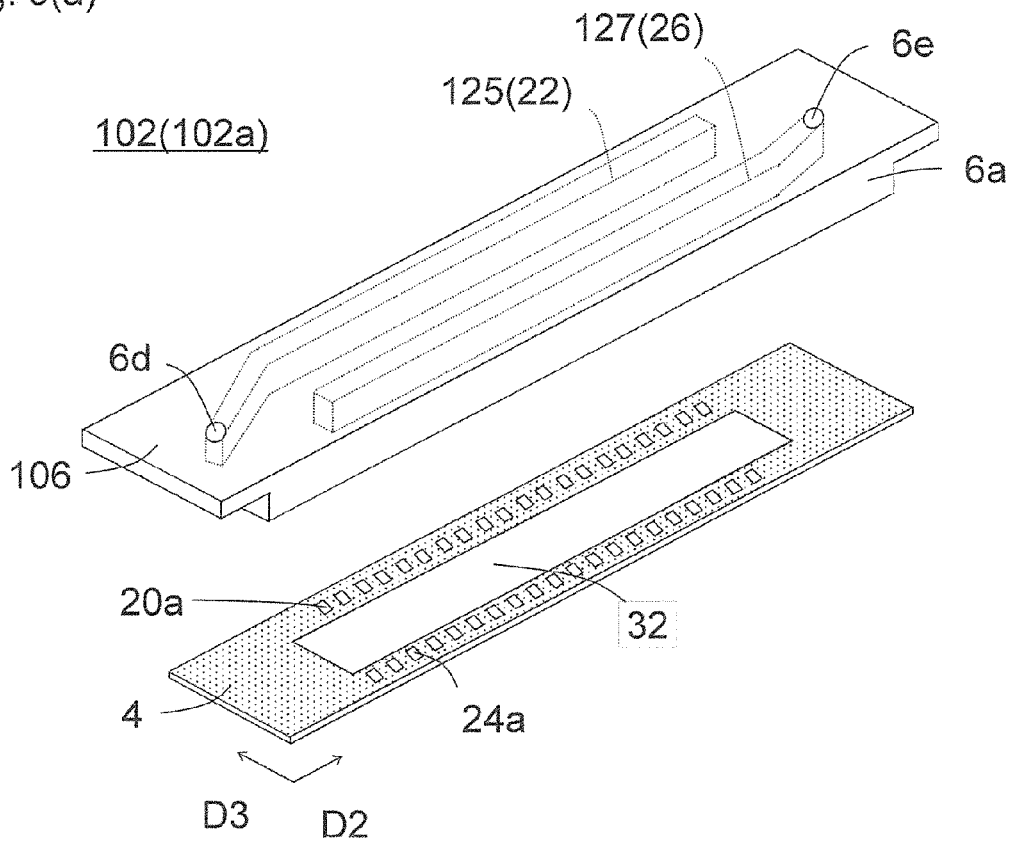
FIG. 9(*a*) is an exploded perspective view of a head body in a liquid discharge head according to a second embodiment, and FIG. 9(*b*) is a plan view thereof.
Figure 9B:
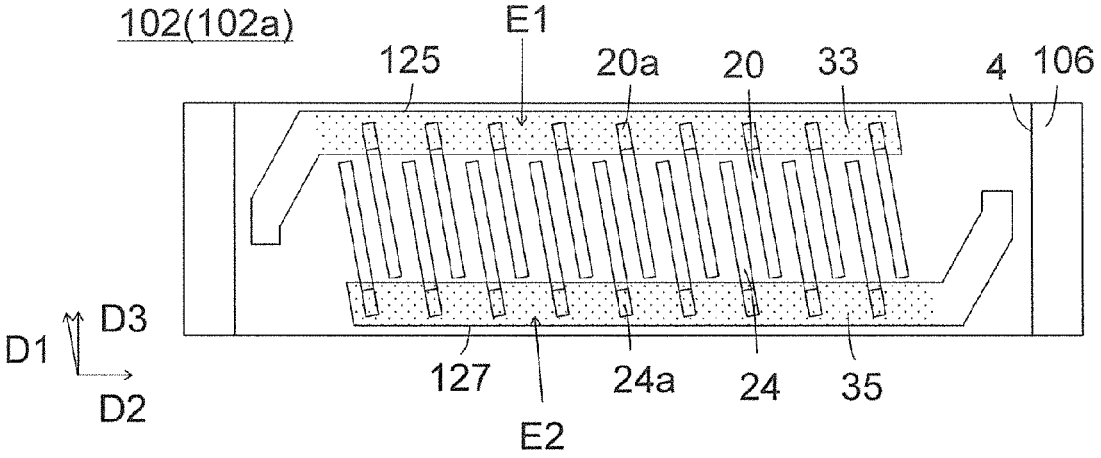

A liquid discharge head 102 according to a second embodiment is described below with reference to FIG. 9. The liquid discharge head 102 differs from the liquid discharge head in the configuration of the second flow channel member 106. Other configurations are the same, and therefore detailed descriptions of the same configurations are omitted. The same parts are identified by the same reference numerals. The same shall apply hereafter.

The second flow channel member 106 is formed only of the first member 6*a*. In other words, the second member 6*b* (refer to FIG. 4) is not disposed therein.

The first member 6*a* has an opening 6*d* and an opening 6*e* formed on an upper surface thereof. The first member 6*a* also has a second supply groove 125 and a second recovery groove 127 formed on a lower surface thereof. The first flow channel member 4 is disposed on the lower surface of the first member 6*a*. The second common supply flow channel 22 is formed of the second supply groove 125 and the first flow channel member 4. The second common recovery flow channel 26 is formed of the second recovery groove 127 and the first flow channel member 4.

The second supply groove 125 is formed long in the second direction D2, and the first supply openings 20*a* are disposed in the second direction D2. The first supply openings 20*a* and the second supply groove 125 are communicated with one another by joining together the first flow channel member 4 and the second flow channel member 6. The second supply groove 125 is disposed over the first supply. The second recovery groove 127 is formed long in the second direction D2, and the first recovery openings 24*a* are disposed in the second direction D2. The first recovery openings 24*a* and the second recovery groove 127 are communicated with one another by joining together the first flow channel member 4 and the second flow channel member 6. The second recovery groove 127 is disposed over the first recovery openings 24*a*.

The first flow channel member 4 and the second flow channel member 6 are joined together in the joint region. Specifically, both are joined together through a first joint region E1 located below the second common supply flow channel 22, and a second joint region E2 located below the second common recovery flow channel 26. In FIG. 9, the first joint region E1 and the second joint region E2 are indicated by dots.

The first common supply flow channel 20 is extended to the first joint region E1 and is connected to the second common supply flow channel 22, and is not extended to the second joint region E2. Similarly, the first common recovery flow channel 24 is extended to the second joint region E2 and is connected to the second common recovery flow channel 26, and is not extended to the first joint region E1.

The first flow channel member 4 has the first supply openings 20*a* and the first recovery openings 24*a* on the first main surface 4*a*-1 to be joined to the second flow channel member 6 (refer to FIG. 7). The first supply openings 20*a* are disposed at equal intervals in the second direction D2, and a partition wall 33 is disposed between the first supply openings 20*a* adjacent to each other. The first recovery openings 24*a* are disposed at equal intervals in the second direction D2, and a partition wall 35 is disposed between the first recovery openings 24*a* adjacent to each other.

In the liquid discharge head 102, the second flow channel member 6 is joined to the first flow channel member 4, and a joint region between the first flow channel member 4 and the second flow channel member 6 has a first joint region E1 disposed below the second common supply flow channel 22, and a second joint region E2 disposed below the second common recovery flow channel 26. The first common supply flow channel 20 is extended to the first joint region E1 and is connected to the second common supply flow channel 22, and is not extended to the second joint region E2 in a plan view from the second flow channel member 6. Similarly, the first common recovery flow channel 24 is extended to the second joint region E2 and is connected to the second common recovery flow channel 26, and is not extended to the first joint region E1

In other words, the first common recovery flow channel 24 is not disposed below the first joint region E1, and the first common supply flow channel 20 is not disposed below the second joint region E2. That is, a portion below the first joint region E1 is not provided with a cavity that becomes the first common recovery flow channel 24, and the portion is solid. A portion below the second joint region E2 is not provided with a cavity that becomes the first common supply flow channel 20, and the portion is solid. Therefore, the rigidity of the first flow channel member 4 located below the first joint region E1 and the second joint region E2 can be enhanced as compared with the case where the first common recovery flow channel 24 is disposed below the first joint region E1 and the first common supply flow channel 20 is disposed below the second joint region. It is consequently strengthen the joint between the first flow channel member 4 and the second flow channel member 6.

In the liquid discharge head 102, the first flow channel member 4 has the first supply openings 20*a* that are connected to the first common supply flow channels 20, open toward the second flow channel member 106, and are disposed in the second direction D2. The second flow channel member 106 has the second supply groove 125 that is connected to the second common supply flow channel 22, opens toward the first flow channel member 4, and is long in the second direction D2. The first supply openings 20*a* and the second supply groove 125 are communicated with one another.

Hence, there is no need to form the second member 6*b* so that the second flow channel member 106 covers the second supply groove 125 (refer to FIG. 4), and the cross-sectional area of the second common supply flow channel 22 can be increased by the amount corresponding to omission of the second member 6*b*, thereby reducing the flow channel resistance in the second common supply flow channel 22. It is consequently possible to prevent enlargement of the liquid discharge head 102 while minimizing the variations in pressure loss that can occur in the pressurizing chambers 10.

Similarly to above, in the liquid discharge head 102, the first flow channel member 4 has the first recovery openings 24*a* that are connected to the first common recovery flow channels 24, open toward the second flow channel member 106, and are disposed in the second direction D2. The second flow channel member 106 has the second recovery groove 127 that is connected to the second common recovery flow channel 26, opens toward the first flow channel member 4, and is long in the second direction D2. The first recovery openings 24*a* and the second recovery groove 127 are communicated with one another.

Hence, there is no need to form the second member 6*b* so that the second flow channel member 106 covers the second recovery groove 127 (refer to FIG. 4), and the cross-sectional area of the second common recovery flow channel 26 can be increased by the amount corresponding to omission of the second member 6*b*, thereby reducing the flow channel resistance in the second common recovery flow channel 26. It is consequently possible to prevent enlargement of the liquid discharge head 102 while minimizing the variations in pressure loss that can occur in the pressurizing chambers 10.

In the liquid discharge head 102, the first supply openings 20*a* are disposed in the second supply groove 125 in the plan view from the second flow channel member 106. It follows that the second common supply flow channel 22 is also formed on a region where the partition wall 33 located between the first supply openings 20*a* adjacent to each other, and the second supply groove 125 are opposed to each other. It is consequently possible to further increase the cross-sectional area of the second common supply flow channel 22, thereby further reducing the flow channel resistance in the second common supply flow channel 22.

Even upon occurrence of a lamination deviation in the first direction D1 when the first flow channel member 4 and the second flow channel member 106 are laminated together, the second supply groove 125 has the function of absorbing the lamination deviation, thereby ensuring the connection between the first supply openings 20*a* and the second supply groove 125.

Similarly to above, in the liquid discharge head 102, the first recovery openings 24*a* are disposed in the second recovery groove 127 in the plan view from the second flow channel member 106. It follows that the second common recovery flow channel 26 is also formed on a region where the partition wall 35 located between the first recovery openings 24*a* adjacent to each other, and the second recovery groove 127 are opposed to each other. It is consequently possible to further increase the cross-sectional area of the second common recovery flow channel 26, thereby further reducing the flow channel resistance in the second common recovery flow channel 26.

Even upon occurrence of a lamination deviation in the first direction D1 when the first flow channel member 4 and the second flow channel member 106 are laminated together, the second recovery groove 127 has the function of absorbing the lamination deviation, thereby ensuring the connection between the first recovery openings 24*a* and the second recovery groove 127.

The liquid discharge head 102 also has a configuration that a length of the first supply openings 20*a* in the third direction D3 is shorter than a length of the second supply groove 125 in the third direction D3 in the plan view from the second flow channel member 106. It is therefore possible to ensure the connection between the first supply openings 20*a* and the second supply groove 125 even upon occurrence of a lamination deviation in the third direction D3 when the first flow channel member 4 and the second flow channel member 106 are laminated together.

Similarly to above, the liquid discharge head 102 also has a configuration that a length of the first recovery openings 24*a* in the third direction D3 is shorter than a length of the second recovery groove 127 in the third direction D3 in the plan view from the second flow channel member 106. It is therefore possible to ensure the connection between the first recovery openings 24*a* and the second recovery groove 127 even upon occurrence of a lamination deviation in the third direction D3 when the first flow channel member 4 and the second flow channel member 106 are laminated together.

Further in the liquid discharge head 102, the first flow channel member 4 is configured by laminating a plurality of plates one upon another. The first flow channel member 4 has the partition wall 33 located between the first supply openings 20*a* adjacent to each other in the second direction D2. A length of the partition wall 33 in the second direction D2 is longer than a length of the first supply openings 20*a* in the second direction D2.

It is therefore possible to increase the number of the regions provided with the partition wall 33 than that of the regions provided with the first supply openings 20*a*. This leads to enhanced rigidity of the first flow channel member 4 in the first joint region E1, thereby strengthening the joint between the first flow channel member 4 and the second flow channel member 106.

Similarly to above, in the liquid discharge head 102, the first flow channel member 4 is configured by laminating a plurality of plates one upon another. The first flow channel member 4 has the partition wall 35 located between the first recovery openings 24*a* adjacent to each other in the second direction D2. A length of the partition wall 35 in the second direction D2 is longer than a length of the first recovery openings 24*a* in the second direction D2.

It is therefore possible to increase the number of the regions provided with the partition wall 35 than that of the regions provided with the first recovery openings 24*a*. This leads to enhanced rigidity of the first flow channel member 4 in the second joint region E2, thereby strengthening the joint between the first flow channel member 4 and the second flow channel member 106.

Third Embodiment

Figure 10:
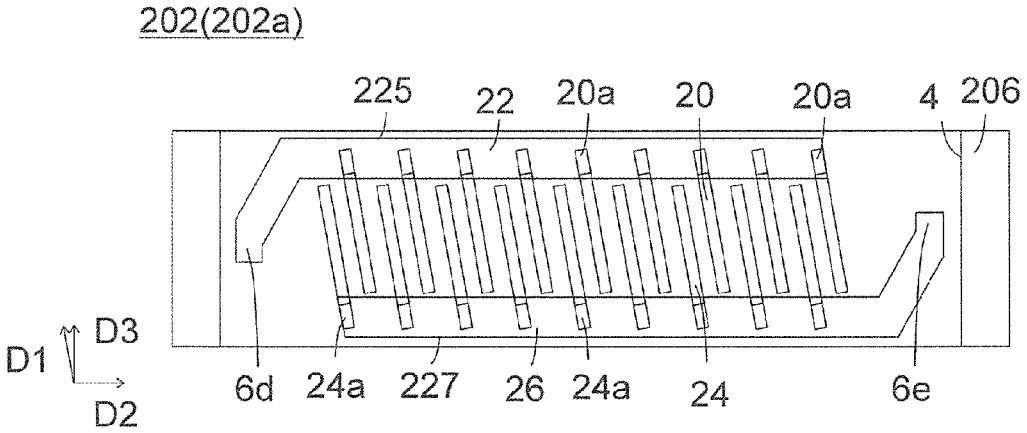
FIG. 10 is a plan view of a head body that constitutes a liquid discharge head according to a third embodiment.

A liquid discharge head 202 according to a third embodiment is described below with reference to FIG. 10. The liquid discharge head 202 differs from the liquid discharge head 102 in the shape of a second supply groove 225 and a second recovery groove 227.

The first flow channel member 4 and the second flow channel member 206 are joined together with an adhesive (not shown) in a joint region (not shown). The second supply groove 225 is formed long in the second direction D2, and an edge of the second supply groove 225 in the second direction D2 is disposed on an edge of the first supply opening 20*a* among the first supply openings 20*a* which is located at an end in the second direction D2.

Therefore, even when due to a large amount of application of the adhesive, the excess adhesive enters the first supply opening 20*a* located at an end portion in the second direction D2, it is possible to reduce the likelihood that the adhesive closes the first supply opening 20*a* because of a large area where the first supply opening 20*a* located at the end portion in the second direction D2 and the second supply groove 225.

The second common supply flow channel 22 is accordingly not disposed closer to the opening 6*e* than to the first supply openings 20*a* located at the end portion in the second direction D2. It is therefore possible to reduce the likelihood that a dead water region is formed by the second supply groove 225 disposed beyond the first supply openings 20*a*, thereby reducing the likelihood that liquid holdup occurs in the second common supply flow channel 22.

The second recovery groove 227 is formed long in the second direction D2, and an edge of the second recovery groove 227 in the second direction D2 is disposed on an edge of the first recovery opening 24*a* among the first recovery openings 24*a* which is located at an end portion in the second direction D2.

Therefore, even when due to a large amount of application of the adhesive, the excess adhesive enters the first recovery opening 24*a* located at the end portion in the second direction D2, it is possible to reduce the likelihood that the adhesive closes the first recovery opening 24*a* because of a large area where the first recovery opening 24*a* located at the end portion in the second direction D2 and the second recovery groove 227.

The second common recovery flow channel 26 is accordingly not disposed closer to the opening 6*d* than to the first recovery openings 24*a* located at the end portion in the second direction D2. It is therefore possible to reduce the likelihood that a dead water region is formed by the second recovery groove 327 disposed beyond the first recovery openings 24*a*, thereby reducing the likelihood that liquid holdup occurs in the second common recovery flow channel 26.

The description that the edge of the second supply groove 225 in the second direction D2 is disposed on the edge of the first supply opening 20*a* among the first supply openings 20*a* which is located at the end portion in the second direction D2 denotes that the edge of the second supply groove 225 in the second direction D2 lies on a region of ±10% in the length of the first supply opening 20*a* in the second direction D2. This is a concept including a manufacturing error.

Fourth Embodiment

Figure 11:
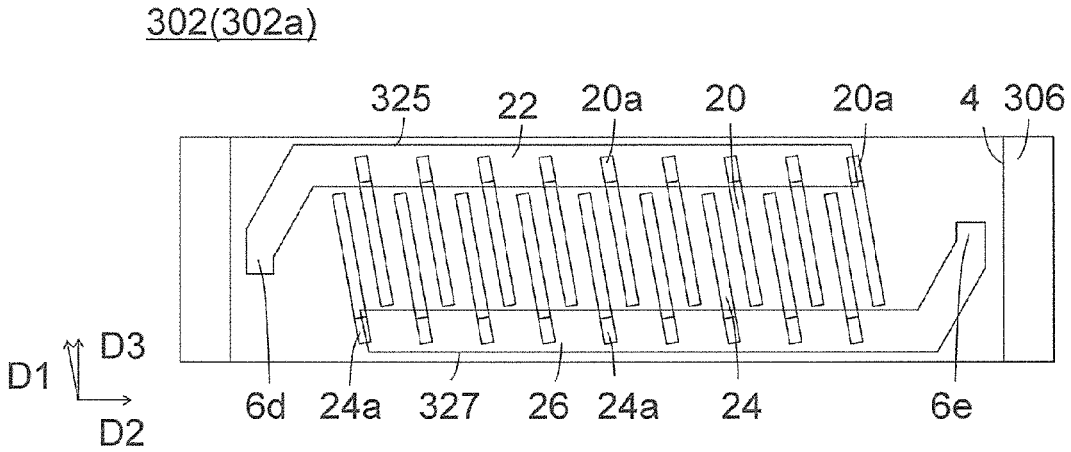
FIG. 11 is a plan view of a head body that constitutes a liquid discharge head according to a fourth embodiment.

A liquid discharge head 302 according to a fourth embodiment is described below with reference to FIG. 11. The liquid discharge head 302 differs from the liquid discharge head 102 in the shape of a second supply groove 325 and a second recovery groove 327.

The second supply groove 325 is formed long in the second direction D2, and an edge of the second supply groove 325 in the second direction D2 is disposed on the first supply opening 20*a* among the first supply openings 20*a* which is located at an end portion in the second direction D2. In other words, the edge of the second supply groove 325 in the second direction D2 is disposed closer to the openings 6*d* than to the edge of the first supply opening 20*a* in the second direction D2 which is located at the end portion in the second direction D2.

Therefore, even upon occurrence of a lamination deviation on the side close to the opening 6*e* in the second direction D2 when the first flow channel member 4 and a second flow channel member 306 are laminated together, it is possible to reduce the likelihood that the edge of the second supply groove 325 in the second direction D2 is disposed beyond the first supply opening 20*a* located at the end portion in the second direction D2.

In other words, the second common supply flow channel 22 is accordingly not disposed closer to the opening 6*e* than to the first supply opening 20*a* located at the end portion in the second direction D2. It is therefore possible to reduce the likelihood that a dead water region is formed by the second supply groove 325 disposed beyond the first supply openings 20*a*, thereby reducing the likelihood that liquid holdup occurs in the second common supply flow channel 22.

The second supply groove 325 is formed long in the second direction D2, an edge of the second recovery groove 327 in the second direction D2 is disposed on the first recovery opening 24*a* among the first recovery openings 24*a* which is located at an end portion in the second direction D2. In other words, the edge of the second recovery groove 327 in the second direction D2 is disposed closer to the opening 6*e* than to the edge of the first recovery opening 24*a* in the second direction D2 which is located at the end portion in the second direction D2.

Therefore, even upon occurrence of a lamination deviation on the side close to the opening 6*e* in the second direction D2 when the first flow channel member 4 and the second flow channel member 306 are laminated together, it is possible to reduce the likelihood that the edge of the second recovery groove 327 in the second direction D2 is disposed beyond the first supply opening 24*a* located at the end portion in the second direction D2.

That is, the second common recovery flow channel 26 is accordingly not disposed closer to the openings 6*d* than to the first recovery opening 24*a* located at the end portion in the second direction D2. It is therefore possible to reduce the likelihood that a dead water region is formed by the second recovery groove 327 disposed beyond the first recovery openings 24*a*, thereby reducing the likelihood that liquid holdup occurs in the second common recovery flow channel 26.

Although the first to fourth embodiments have been described above, the present invention is not limited to the foregoing embodiments, and various changes can be made therein as long as they do not depart from the gist of the present invention.

For example, as the pressurizing part, the embodiment in which the pressurizing chambers 10 are pressurized by the piezoelectric deformation of the piezoelectric actuator has been described without limitation thereto. For example, the pressurizing part may be configured so that a heating part is disposed for each of the pressurizing chambers 10, a liquid in the pressurizing chambers 10 is heated by heat of the heating part, and the pressuring chambers 10 are pressurized by thermal expansion of the liquid.

Although the embodiment in which the liquid is supplied to the openings 6*d* of the second flow channel member 6 and the liquid is recovered from the opening 6*e* has been described, the liquid may be supplied to the openings 6*e* of the second flow channel member 6, and the liquid may be recovered from the openings 6*d*. On that occasion, the liquid supplied to the opening 6*e* is supplied to each of the first common recovery flow channels 24 while flowing through the second common recovery flow channel 26 along the second direction D2. The liquid that has been supplied to the first common recovery flow channel 24 is supplied through the second flow channel 14 to each of the pressurizing chambers 10 while flowing through the first common recovery flow channel 24 along the first direction D1. The liquid that has been supplied to the pressurizing chambers 10 then flows along the first direction D1 while being recovered via the first flow channel 12 into the first common supply flow channel 20. The liquid that has been recovered into the first common supply flow channel 20 then flows along the second direction D2 while being recovered into the second common supply flow channel 22. The liquid is then recovered from the opening 6*d* to the outside.

DESCRIPTION OF REFERENCE NUMERALS

1 printer
2 liquid discharge head
2*a* head body
4 first flow channel member
6 second flow channel member
8 discharge hole
10 pressurizing chamber
12 first flow channel
14 second flow channel
20 first common supply flow channel
20*a* first supply opening
22 second common supply flow channel
22*a* second common supply flow channel body
22*b* supply connection flow channel
24 first common recovery flow channel
24*a* first recovery opening
26 second common recovery flow channel
26*a* second common recovery flow channel body
26*b* recovery connection flow channel
40 piezoelectric actuator substrate
50 displacement element (pressurizing part)
70 frame
72 head group
88 control section
92 signal transmission section
D1 first direction
D2 second direction
D3 third direction
E1 first joint region
E2 second joint region
P printing paper

The invention claimed is:

1. A liquid discharge head, comprising:

a plurality of first flow channel members, each comprising a plurality of discharge holes, a plurality of pressurizing chambers respectively connected to the discharge holes, a plurality of first common supply flow channels connected in common to the pressurizing chambers and configured to supply a liquid to the pressurizing chambers, a plurality of first common recovery flow channels connected in common to the pressurizing chambers and configured to recover the liquid from the pressurizing chambers, wherein the first common supply flow channels and the first common recovery flow channels are long in a first direction, and the first flow channel members are disposed in a second direction being a direction intersecting the first direction;

a second flow channel member comprising a second common supply flow channel connected in common to the first common supply flow channels and configured to supply the liquid to the first common supply flow channels, a second common recovery flow channel connected in common to the first common recovery flow channels and configured to recover the liquid from the first common recovery flow channels;

a plurality of pressurizing parts configured to respectively pressurize the liquid in the pressurizing chambers, wherein the second flow channel member is disposed on the first flow channel member, and wherein the first flow channel member and the second flow channel member are long in the second direction, and the second common supply flow channel and the second common recovery flow channel are also long in the second direction.

2. The liquid discharge head according to claim 1, wherein a cross-sectional area of the second common supply flow channel is larger than a cross-sectional area of the first common supply flow channel, and wherein a cross-sectional area of the second common recovery flow channel is larger than a cross-sectional area of the first common recovery flow channel.

3. The liquid discharge head according to claim 2, wherein a flow channel resistance in the second common supply flow channel is 1/100 or less of a flow channel resistance in the first common supply flow channels, and a flow channel resistance in the second common recovery flow channel is 1/100 or less of a flow channel resistance in the first common recovery flow channel.

4. The liquid discharge head according to claim 1, wherein the pressurizing parts are disposed in a central part of the first flow channel member in a plan view from the second flow channel member, and wherein the second flow channel member is disposed on an outer peripheral part of the first flow channel member.

5. The liquid discharge head according to claim 4, further comprising:

a signal transmission section configured to transmit a signal for driving the pressurizing parts.

6. The liquid discharge head according to claim 1, wherein the second common supply flow channel is disposed on one end portion of the first flow channel member in a third direction orthogonal to the second direction in the plan view from the second flow channel member, and wherein the second common recovery flow channel is disposed on another end portion of the first flow channel member in the third direction.

7. The liquid discharge head according to claim 6, wherein the second flow channel member is joined to the first flow channel member, wherein a joint region between the first flow channel member and the second flow channel member comprises a first joint region located below the second common supply flow channel, and a second joint region disposed below the second common recovery flow channel, wherein the first common supply flow channel is extended to the first joint region and is connected to the second common supply flow channel and is not extended to the second joint region in the plan view from the second flow channel member, and wherein the first common recovery flow channel is extended to the second joint region and connected to the second common recovery flow channel, and is not extended to the first joint region.

8. The liquid discharge head according to claim 1, wherein the first flow channel member comprises a plurality of first supply openings being connected to the first common supply flow channels and configured to open toward the second flow channel member, and being disposed in the second direction, wherein the second flow channel member comprises a second supply groove being connected to the second common supply flow channel, being configured to open toward the first flow channel member, and being long in the second direction, and wherein the first supply openings and the second supply groove are communicated with one another.

9. The liquid discharge head according to claim 8, wherein the first supply openings are disposed in the second supply groove in the plan view from the second flow channel member.

10. The liquid discharge head according to claim 8, wherein a length of each of the first supply openings in the third direction orthogonal to the second direction is shorter than a length of the second supply groove in the third direction in the plan view from the second flow channel member.

11. The liquid discharge head according to claim 8, wherein the second flow channel member is joined via an adhesive material to the first flow channel member, and wherein an edge of the second supply groove in the second direction is disposed on an edge of the first supply opening among the first supply openings which is located at an end portion in the second direction.

12. The liquid discharge head according to claim 8, wherein an edge of the second supply groove in the second direction is disposed on the first supply opening among the first supply openings which is located at an end portion in the second direction.

13. The liquid discharge head according to claim 8, wherein the first flow channel member is formed of a plurality of plates laminated one upon another, wherein the first flow channel member comprises a partition wall located between the first supply openings adjacent to each other in the second direction, and wherein a length in the partition wall in the second direction is longer than a length of each of the first supply openings in the second direction.

14. The liquid discharge head according to claim 8, wherein the first flow channel member comprises a plurality of recovery openings being respectively connected to the first common recovery flow channels and configured to open toward the second flow channel member, and being disposed in the second direction, wherein the second flow channel member comprises a second recovery groove being connected to the second common recovery flow channel and configured to open toward the first flow channel member, and being long in the second direction, and wherein the first recovery openings and the second recovery groove are communicated with each other.

15. The liquid discharge head according to claim 14, wherein the first recovery openings are disposed in the second recovery groove in the plan view from the second flow channel member.

16. The liquid discharge head according to claim 14, wherein a length of each of the first recovery openings in the third direction orthogonal to the second direction is shorter than a length of the second recovery groove in the third direction in the plan view from the second flow channel member.

17. The liquid discharge head according to claim 14, wherein the second flow channel member is joined via an adhesive material to the first flow channel member, wherein an edge of the second recovery groove in the second direction is disposed on an edge of the first recovery opening among the first recovery openings which is located at an end portion in the second direction.

18. The liquid discharge head according to claim 14, wherein an edge of the second recovery groove in the second direction is disposed on the first recovery opening among the first recovery openings which is located at an end portion in the second direction.

19. The liquid discharge head according to claim 14, wherein the first flow channel member is formed of a plurality of plates laminated one upon another, wherein the first flow channel member comprises a partition wall located between the first recovery openings adjacent to each other in the second direction, and wherein a length in the partition wall in the second direction is longer than a length of each of the first recovery openings in the second direction.

20. A recording device, comprising:

a liquid discharge head according to claim 1;

a transport section configured to transport a recording medium to the liquid discharge head; and a control section configured to control the liquid discharge head.

* * * * *